US010051920B2

(12) United States Patent
Chen

(10) Patent No.: US 10,051,920 B2
(45) Date of Patent: Aug. 21, 2018

(54) LACING SYSTEM

(71) Applicant: Chi-Hsun Chen, Taichung (TW)

(72) Inventor: Chi-Hsun Chen, Taichung (TW)

( * ) Notice: Subject to any disclaimer, the term of this patent is extended or adjusted under 35 U.S.C. 154(b) by 0 days.

(21) Appl. No.: 15/326,039

(22) PCT Filed: Jul. 17, 2015

(86) PCT No.: PCT/CN2015/084358

§ 371 (c)(1),
(2) Date: Jan. 13, 2017

(87) PCT Pub. No.: WO2016/008448

PCT Pub. Date: Jan. 21, 2016

(65) Prior Publication Data

US 2017/0202315 A1 Jul. 20, 2017

(30) Foreign Application Priority Data

Jul. 18, 2014 (CN) ..... 2014 2 0397685 U

(51) Int. Cl.
*A43C 11/16* (2006.01)
*A43C 1/00* (2006.01)

(52) U.S. Cl.
CPC ..... *A43C 11/165* (2013.01); *A43C 1/00* (2013.01)

(58) Field of Classification Search
CPC Y10T 24/2187; Y10T 24/2183; A43C 11/165
See application file for complete search history.

(56) References Cited

U.S. PATENT DOCUMENTS 6,502,286 B1 * 1/2003 Dubberke ..... A43C 7/00 24/712.1
2005/0098673 A1 * 5/2005 Huang ..... A43C 7/00 242/395
2011/0266384 A1 * 11/2011 Goodman ..... A43C 11/165 242/396.4

* cited by examiner

*Primary Examiner* — Robert Sandy
(74) *Attorney, Agent, or Firm* — CKC & Partners Co., Ltd.

(57) ABSTRACT

A lacing system includes an article, a guiding portion, a lace and a fastening mechanism. The lacing zone is located between the first side and the second side. The guiding portion is positioned at the article and includes a first guide and a second guide. The first guide is positioned on the first side and located in the lacing zone. The second guide is positioned on the second side and located in the lacing zone. The lace is guided by the guiding portion and extended in a zig-zag pattern throughout the lacing zone. The fastening mechanism is positioned at the article to loosen or fasten the lace, which includes a housing and a reel member. The housing includes a connecting hole and a passage. The reel member is coupled to the housing to loosen or fasten the lace and is rotated along a first direction relating to the housing.

10 Claims, 10 Drawing Sheets

LACING SYSTEM

CROSS-REFERENCE TO RELATED APPLICATION

This application is a continuation of International application No. PCT/CN2015/084358, filed Jul. 17, 2015, which claims the benefits of priority of CN application No. 201420397685.3 filed on Jul. 18, 2014, the content of which are incorporated herein by reference.

BACKGROUND

Technical Field

The present disclosure relates to a lacing system. More particularly, the present disclosure relates to a lacing system which can simplify the tying steps.

Description of Related Art

A lace is conventionally used with holes to tight an article, and two ends of the lace are knotted to secure or cover the article. Take a shoe as an example, a shoelace is passed through eyelets and is extended in a zig-zag pattern between two sides of the shoe. A User draws the shoelace to close the two sides of the shoe and then knots the shoelace to keep the tension of the shoelace so as to secure the shoelace on the shoe. However, the knots at both ends of the shoelace is easily loosed by the interference of external forces, and an accident may happen if the user is careless.

In order to improve the abovementioned problems, machine structure is used to keep the tension of the lace; hence, some fastening products which have securing ability are developed. Such fastening products have lots of components, which results in high producing cost, and the fastening products are easily disabled if a single component is broken. Besides, the user cannot maintain the fastening product himself/herself due to the complex relationships between the components. Although the fastening products can have securing ability, they are not easily to be loosed and cannot release the article quickly.

Therefore, how to develop a fastening produce with low cost and high convenience becomes a pursuit target for practitioners.

SUMMARY

The present disclosure provides a lacing system to fasten the lace and to prevent the lace from loosening, and the article can be fastened and loosened quickly and efficiently. Besides, the load of the lace is balanced, and the article can be fastened efficiently, too. Furthermore, the structure of the lacing system can be simplified so as to reduce the producing cost.

A lacing system includes an article, a guiding portion, a lace and a fastening mechanism. The article includes a first side, a second side and a lacing zone. The second side corresponds to the first side. The lacing zone is located between the first side and the second side. The guiding portion is positioned at the article and includes a first guide and a second guide. The first guide is positioned on the first side and located in the lacing zone. The first guide faces toward the second side. The second guide is positioned on the second side and located in the lacing zone. The second guide faces toward the first side. The lace is guided by the guiding portion and extended in a zig-zag pattern throughout the lacing zone. The fastening mechanism is positioned at the article to loosen or fasten the lace, which includes a housing and a reel member. The housing includes a connecting hole and a passage. The connecting hole is provided for the lace to enter the fastening mechanism, and the passage is positioned at the housing to allow the lace to pass through the fastening mechanism. The reel member is coupled to the housing to loosen or fasten the lace and is rotated along a first direction relating to the housing. A first end of the lace is passed through the passage and the connecting hole to detachably connect to the reel member, and a second end of the lace is passed through the connecting hole to detachably connect to the reel member. The first and second ends of the lace are fastened by rotating the reel member along the first direction.

In the above embodiment, the reel member further includes a handheld portion integrally connected to the reel member. The handheld portion is for manually controlling the rotation of the reel member.

Therefore, the lace will be passed through the passage and be received inside the fastening mechanism by winding the reel member, and the lace will not be loosed due to the interference of the external environment. The handheld portion can rotate the reel member to wind the lace so as to fasten or loosen the article quickly. Besides, the handheld portion is integrally formed on the reel member, and other component can be omitted. Hence, the structure can be simplified, and the lacing system will not be disable owing to the failure of a single component. Moreover, the producing cost and assembling time can be reduced because of the simplification of the structure.

In one embodiment, the fastening mechanism further includes a pawl coupled to the reel member to inhibit the reel member from rotating. The reel member further includes a plurality of engaging teeth integrally connected to the reel member, and the engaging teeth are coordinated with the pawl to restrict a rotating direction of the reel member. When the pawl is engaged with the engaging teeth, the reel member is only allowed to rotate along the first direction. When the pawl is disengaged with the engaging teeth, the reel member is allowed to rotate freely. The lacing system further includes a releasing mechanism positioned at the fastening mechanism, and a disengagement and an engagement between the pawl and the engaging teeth are controlled by the releasing mechanism.

A lacing system includes an article, a guiding portion, a lace and a fastening mechanism. The article includes a first side, a second side and a lacing zone. The second side corresponds to the first side. The lacing zone is located between the first side and the second side. The guiding portion is positioned at the article and includes a first guide and a second guide. The first guide is positioned on the first side and located in the lacing zone. The first guide faces toward the second side. The second guide is positioned on the second side and located in the lacing zone. The second guide faces toward the first side. The lace is guided by the guiding portion and extended in a zig-zag pattern throughout the lacing zone. The fastening mechanism is positioned at the article to loosen or fasten the lace, which includes a housing and a reel member. The housing includes a connecting hole and a passage. The connecting hole is provided for the lace to enter the fastening mechanism, and the passage is positioned at the housing to allow the lace to pass through the fastening mechanism. The reel member is coupled to the housing to loosen or fasten the lace and is rotated along a first direction relating to the housing. A first end of the lace is passed through the passage and the connecting hole to securely connect inside the housing, and a second end of the lace is passed through the connecting hole to detachably connect to the reel member and is rotated by the reel member. The second end of the lace is fastened by rotating the reel along the first direction.

Therefore, the lace can be wound into the fastening mechanism, and the lace will not be loosened due to the interference of the external environment. Besides, the passage can allow the lace to pass through the fastening mechanism without affected by the reel member. Hence, the structure of the fastening mechanism can be configured according to the demands, and the load of the lace is balanced while fastening. The lace is not easily broken and the life time of the lace is increased.

In one embodiment, the fastening mechanism can further include a pawl, and the pawl is coupled to the reel member to restrict the rotation of the reel member. The fastening mechanism further includes a plurality of limiting teeth, the limiting teeth are coordinated with the pawl to restrict the rotating direction of the reel member.

The lacing system can be applied to fasten all kinds of article. The article can be applied to all kinds of products, such as shoes, gloves, hats, braces, sport apparatus or rehabilitation apparatus, which need to be securely worn on a human body.

The lacing system includes the following advantages: 1. the lace can be received inside the fastening mechanism such that the lace will not be loosed owing to the interference of the external environment. 2. broken of the lace can be prevent due to the balanced load of the lace, and the article can be efficiently fastened or covered. 3. the article can be released quickly by the releasing mechanism. 4. the structure is simplified, and a disablement of the lacing system can be avoid.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
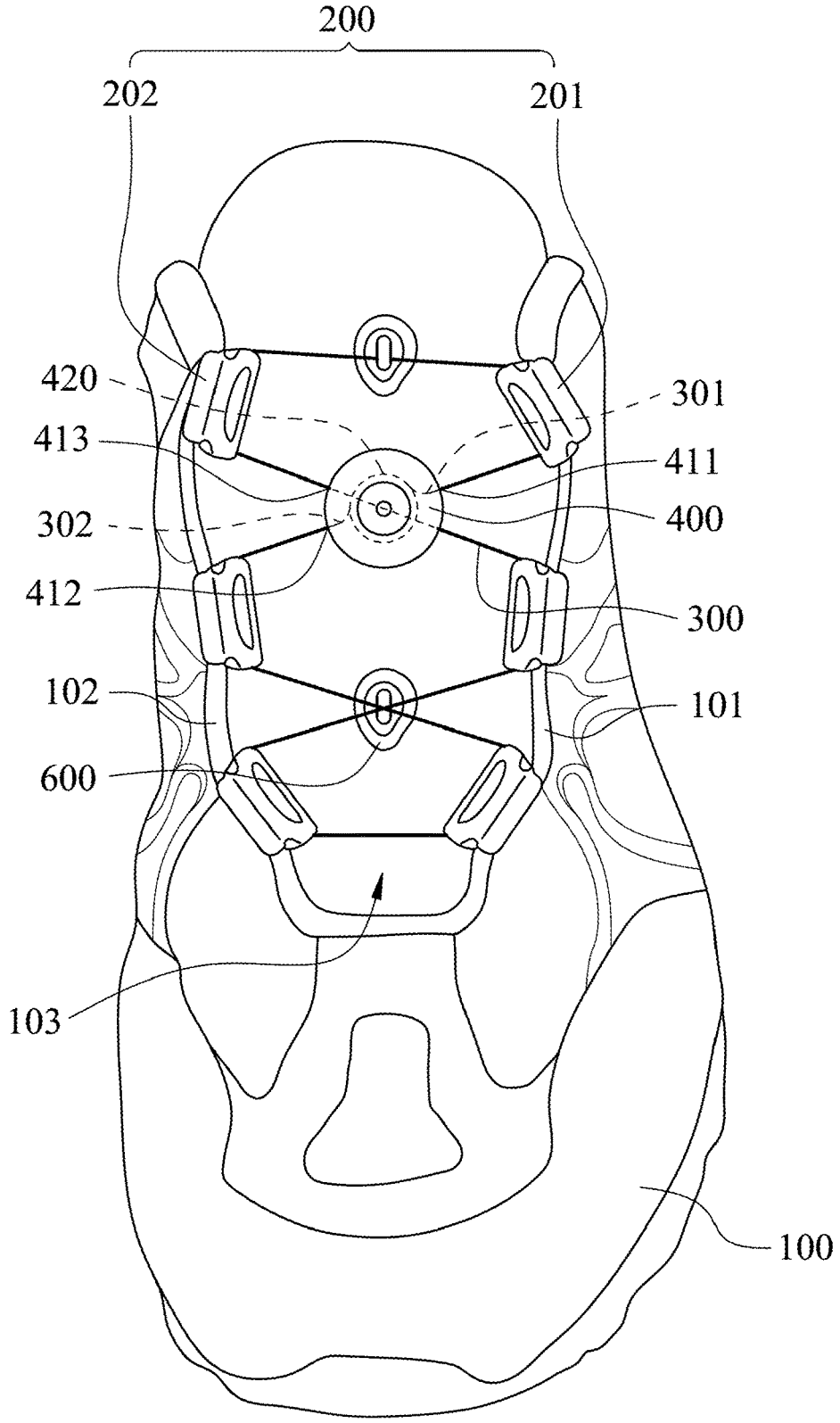
FIG. 1 shows a schematic view of a lacing system according to one embodiment of the present disclosure.

Please refer to FIG. 1. FIG. 1 shows a schematic view of a lacing system according to one embodiment of the present disclosure. In this embodiment, a shoe 100 can be deemed as the article. The lacing system includes a shoe 100, three guiding portions 200, a lace 300, a fastening mechanism 400 and two anti-friction members 600.

The shoe 100 includes a first side 101, a second side 102 and a lacing zone 103. The second side 102 corresponds to the first side 101, and the second side 102 and the first side 101 cover around the foot. The lacing zone 103 is located between the first side 101 and the second side 102.

The guiding portion 200 includes a first guide 201 and a second 202. The first guide 201 is positioned on the first side 101 and located in the lacing zone 103. The first guide 201 faces toward the second side 102. The second guide 202 is positioned on the second side 102 and located in the lacing zone 103. The second guide 202 faces toward the first side 101.

The lace 300 is guided by the guiding portions 200. The lace 300 is reciprocatedly threaded between the first guides 201 and the second guides 202, and the lace 300 is extended in a zig-zag pattern throughout the lacing zone 103.

Figure 2:
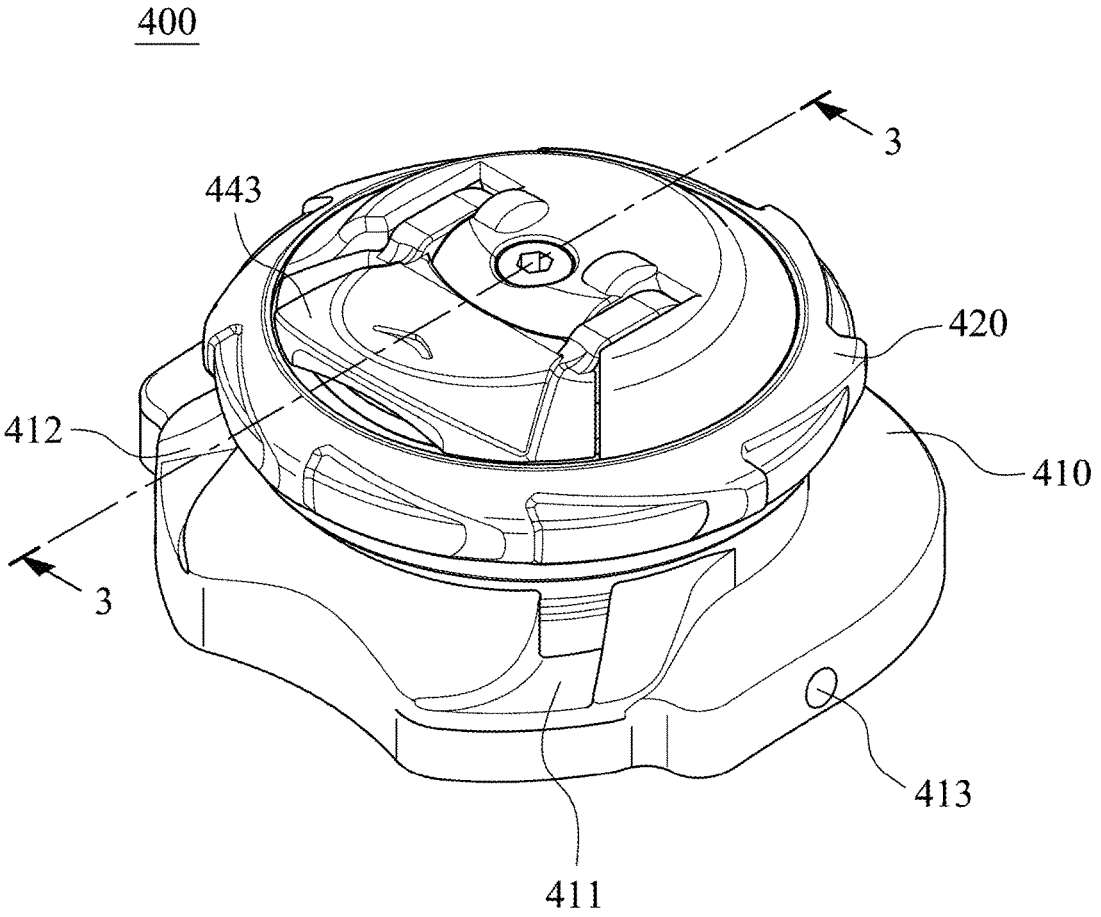
FIG. 2 shows a schematic view of a fastening mechanism of FIG. 1.
Figure 3A:
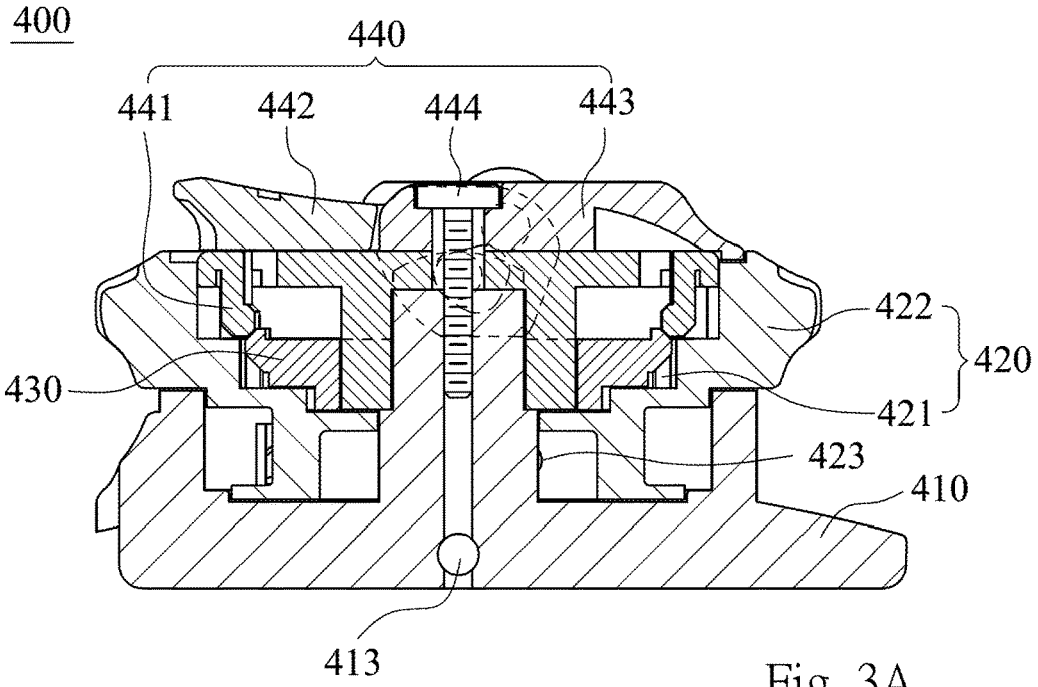
FIG. 3A shows a cross-sectional view of the fastening mechanism of FIG. 2 under an engaging state taken along Line 3-3.
Figure 3B:
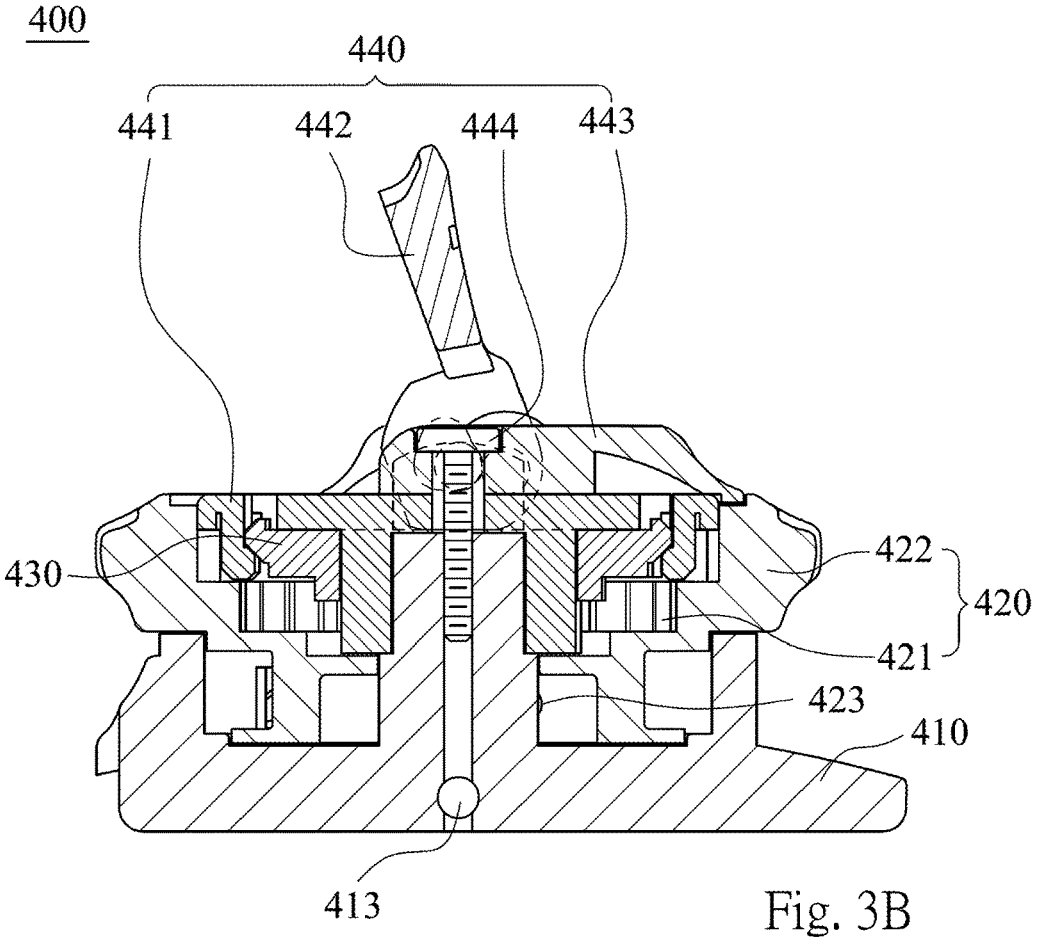
FIG. 3B shows a cross-sectional view of the fastening mechanism of FIG. 2 under a disengaging state taken along Line 3-3.
Figure 4:
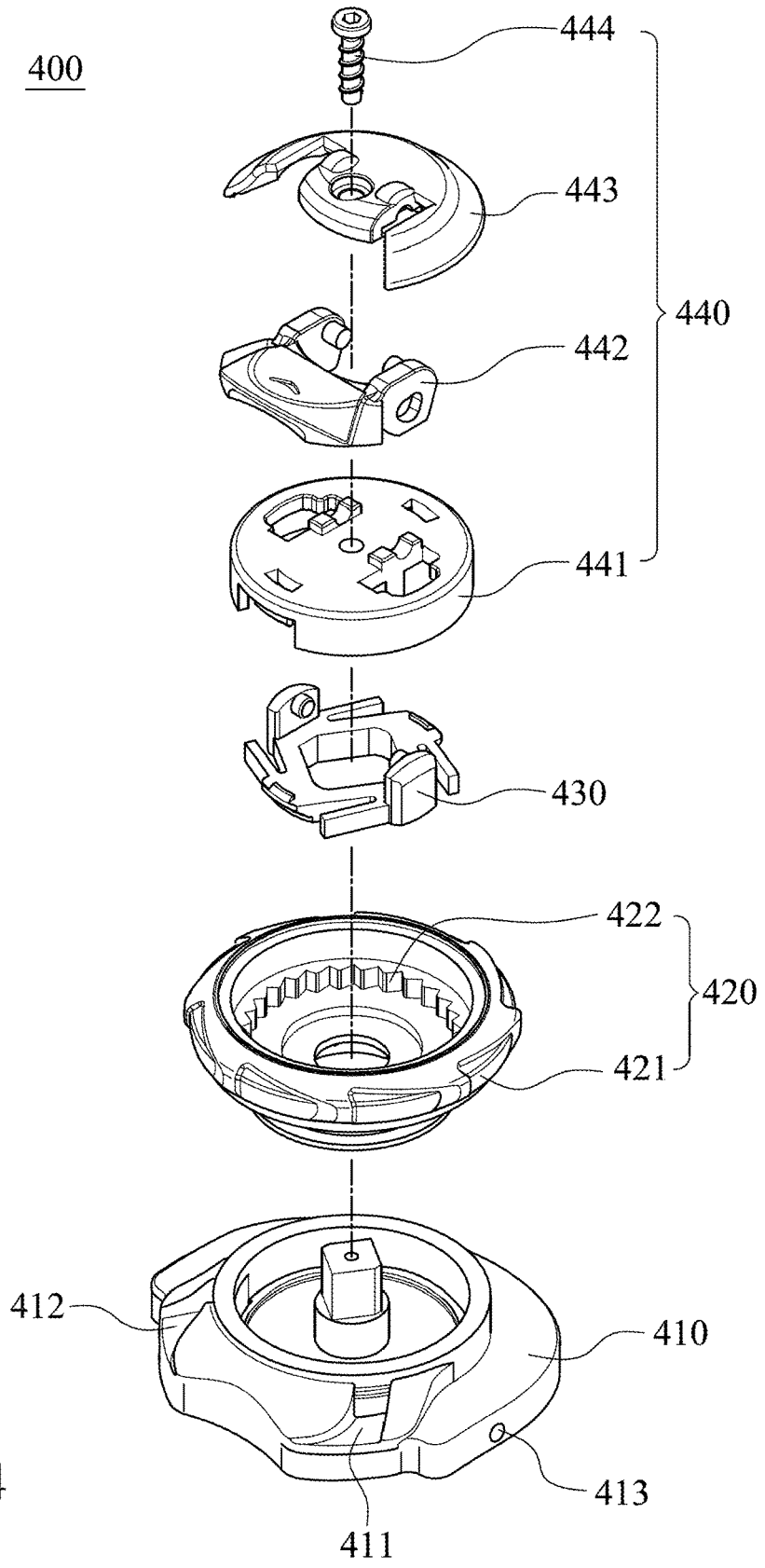
FIG. 4 shows an exploded view of the fastening mechanism of FIG. 2.

Please refer to FIGS. 2 to 4 for the structure of the fastening mechanism 400. FIG. 2 shows a schematic view of the fastening mechanism 400 of FIG. 1. FIG. 3A shows a cross-sectional view of the fastening mechanism 400 of FIG. 2 under an engaging state taken along Line 3-3. FIG. 3B shows a cross-sectional view of the fastening mechanism 400 of FIG. 2 under a disengaging state taken along Line 3-3. FIG. 4 shows an exploded view of the fastening mechanism 400 of FIG. 2.

The fastening mechanism 400 includes a housing 410, a reel member 420, a pawl 430 and a releasing mechanism 440. The housing 410 includes a first connecting hole 411, a second connecting hole 412 and a passage 413. A first end 301 of the lace 300 is guided by the first guide 201 and the second guide 202 to enter the fastening mechanism 400 via the first connecting hole 411. The first end of the lace 300 is detachably connected to the reel member 420. Precisely, as shown in FIGS. 3A and 3B, the reel member 420 includes a knotting hole 423. The first end 301 can be knotted after passing through the knotting hole 423 such that the first end 301 is detachably connected to the reel member 420. A second end 302 of the lace 300 is guided by the first guides 201 and the second guides 202 in a zigzag pattern to enter the fastening mechanism 400 via the second connecting hole 412, and the second end 302 of the lace 300 is detachably connected to the reel member 420. Similarly, the second end 302 can pass through the knotting hole 423 to be detachably connected to the reel member 420. In other word, the first end 301 of the lace 300 is passed through the passage 413, the guiding portion 200 and the connecting hole 411 to detachably connect to the reel member 420, and the second end 302 of the lace 300 is passed through the connecting hole 412 to detachably connect to the reel member 420. The first end 301 and the second end 302 of the lace 300 are fastened simultaneously by rotating the reel member 420 along the first direction.

The reel member 420 is coupled to the housing 410 to loosen or fastening the lace 300, and the reel member 420 can be rotated along a first direction relative to the housing 410. The reel member 420 includes a handheld portion 421 and a plurality of engaging teeth 422. The handheld portion 421 is integrally connected to the reel member 420. The handheld portion 421 is for manually controlling the rotation of the reel member 420. The engaging teeth 422 are integrally connected to the reel member 420.

The pawl 430 is coordinated with the engaging teeth 422 to restrict a rotation direction of the reel member 420. When the pawl 430 is engaged with the engaging teeth 422, the reel member 420 can only be rotated along the first direction. When the pawl 430 is disengaged with the engaging teeth 422, the reel member 420 can be rotated freely.

The releasing mechanism 440 is disposed at the fastening mechanism 400 to control the engagement and disengagement between the pawl 430 and the engaging teeth 422. The releasing mechanism 440 includes a lower cover 441, a releasing button 442, an upper cover 443 and a screw 444. The pawl 430 is disposed at the lower cover 441 and is received inside the reel member 420 when the lower cover 441 is assembled with the reel member 420. The releasing button 442 is pivotally disposed at the lower cover 441 and clamped between the upper cover 443 and the lower cover 441. The upper cover 443 and the lower cover 441 is fastened by the screw 444.

Please refer to FIGS. 3A and 3B. When the releasing button 442 is fully abutted the lower cover 441 (as shown in FIG. 3A), the pawl 430 is engaged with the engaging teeth 422. The reel member 420 is limited by the pawl 430 and can only be rotated along the first direction to loosen the first and second ends of the lace 300 simultaneously. When the releasing button 442 is pushed upward (as shown in FIG. 3B), the pawl 430 is disengaged with the engaging teeth 422. The reel member 420 is not limited by the pawl 430 and can be rotated freely due to the tension of the lace 300; therefore, the first and second ends of the lace 300 can be quickly loosened simultaneously.

The anti-friction member 600 is disposed in the lacing zone 103 of the shoe 100 to allow the lace 300 to pass through. When the lace 300 is threaded back and forth through the lacing zone 103, the anti-friction member 600 can prevent friction occurred thereof.

The lace 300 can be passed through the fastening mechanism 400 and can be wound inside the fastening mechanism 400 by the reel member 420. Accordingly, the lace 300 will not be loosed owing to the interference of the external environment. The handheld portion 421 is for directly rotating the reel member 420 to wind the lace 300, and the lace 300 can be released quickly by the releasing mechanism 440 so as to loosen the shoe 100. Besides, the handheld portion 421 and the reel member 420 are formed integrally, and other component can be omitted. Therefore, the structure can be simplified, and the fastening mechanism 400 will not be disabled due to failure of a single component. Furthermore, the producing cost and assembling time can be reduced owning to the simplified structure.

The other embodiment of the present disclosure includes a shoe, a guiding portion, a lace and a fastening mechanism. The connecting relationship of the main components is similar to the embodiment mentioned above, but the first end of the lace passes through the passage and the connecting hole to securely connect to the housing and the second end passes the connecting hole to detachably connect to the reel member so as to be wound by the reel member. When the reel member is rotated along the first direction, the second end of the lace can be wound.

Figure 5:
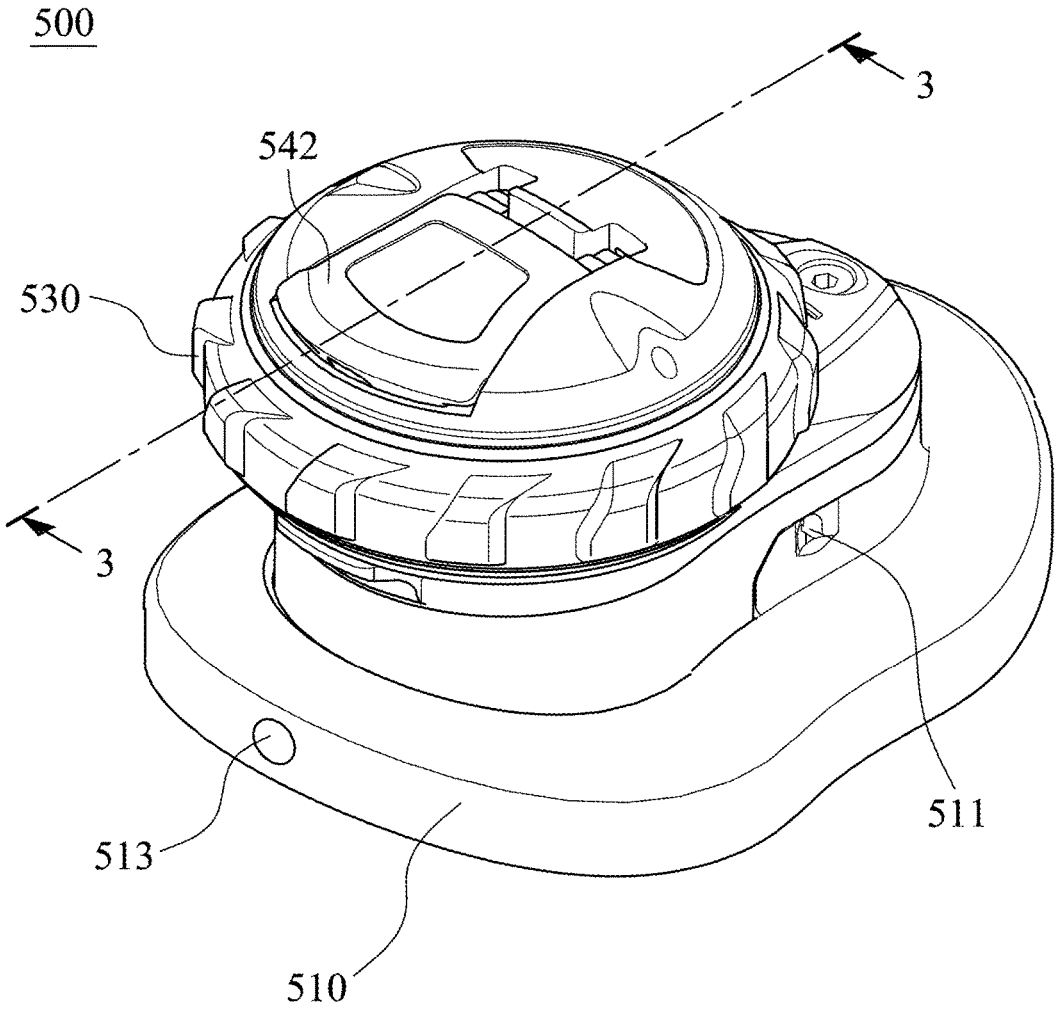
FIG. 5 shows a schematic view of a fastening mechanism of a lacing system according to another embodiment of the present disclosure.
Figure 6A:
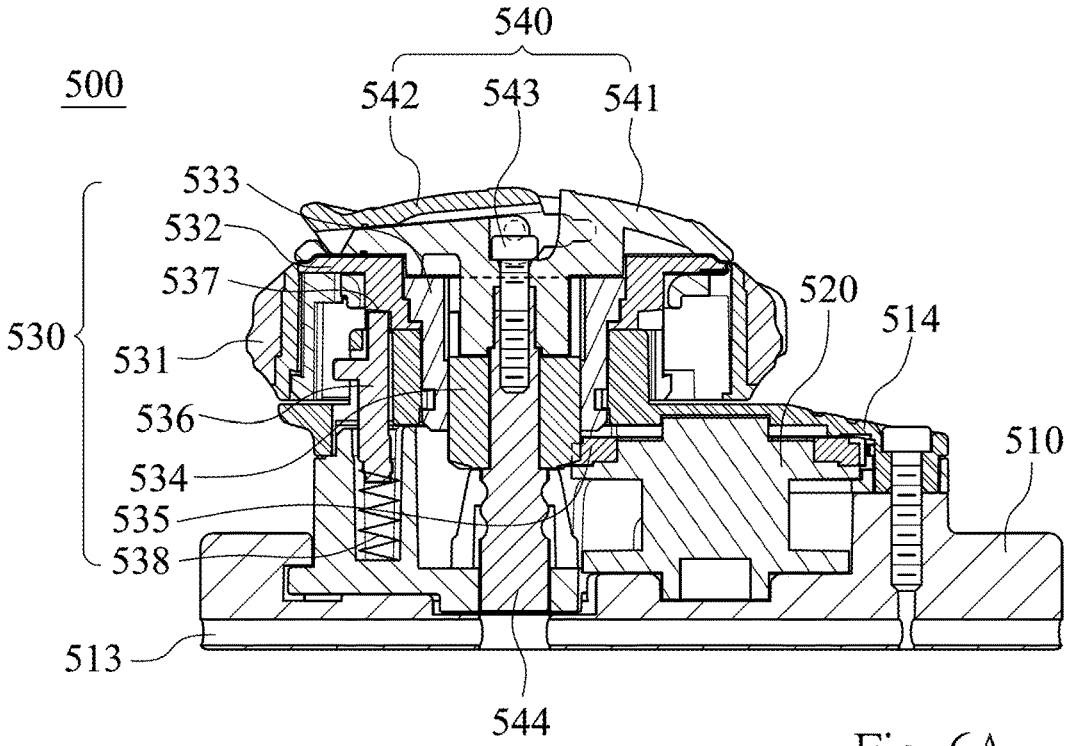
FIG. 6A shows a cross-sectional view of the fastening mechanism of FIG. 5 under an engaging state taken along Line 3-3.
Figure 6B:
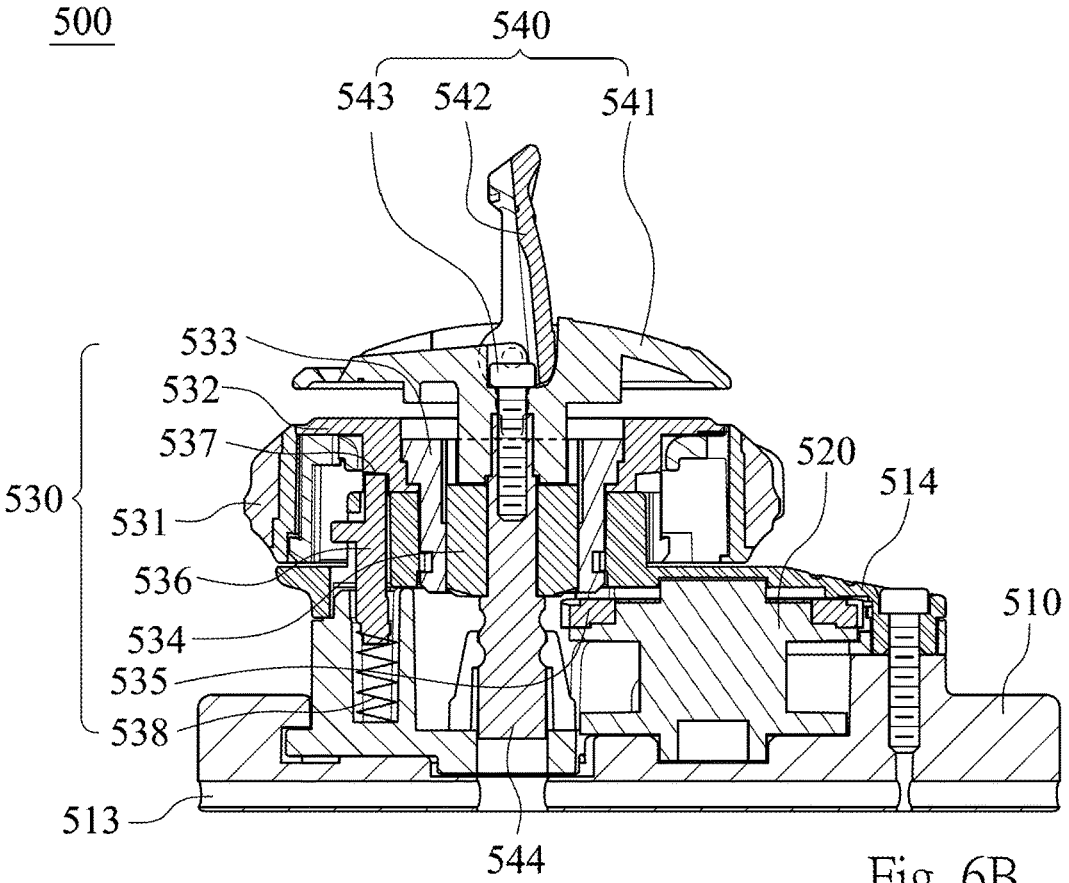
FIG. 6B shows a cross-sectional view of the fastening mechanism of FIG. 5 under a disengaging state taken along Line 3-3.
Figure 7:
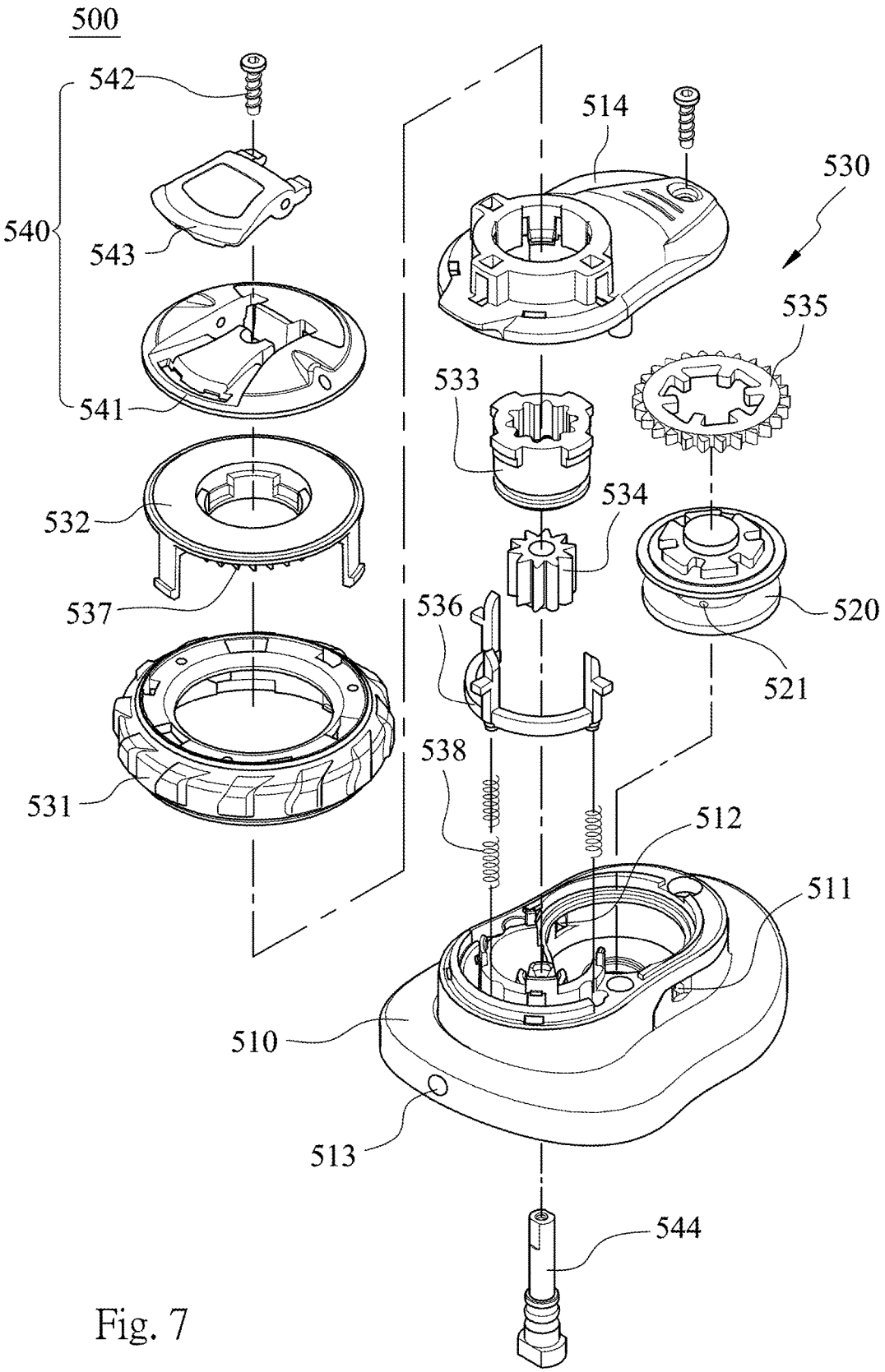
FIG. 7 shows an exploded view of the fastening mechanism of FIG. 5.
Figure 8:
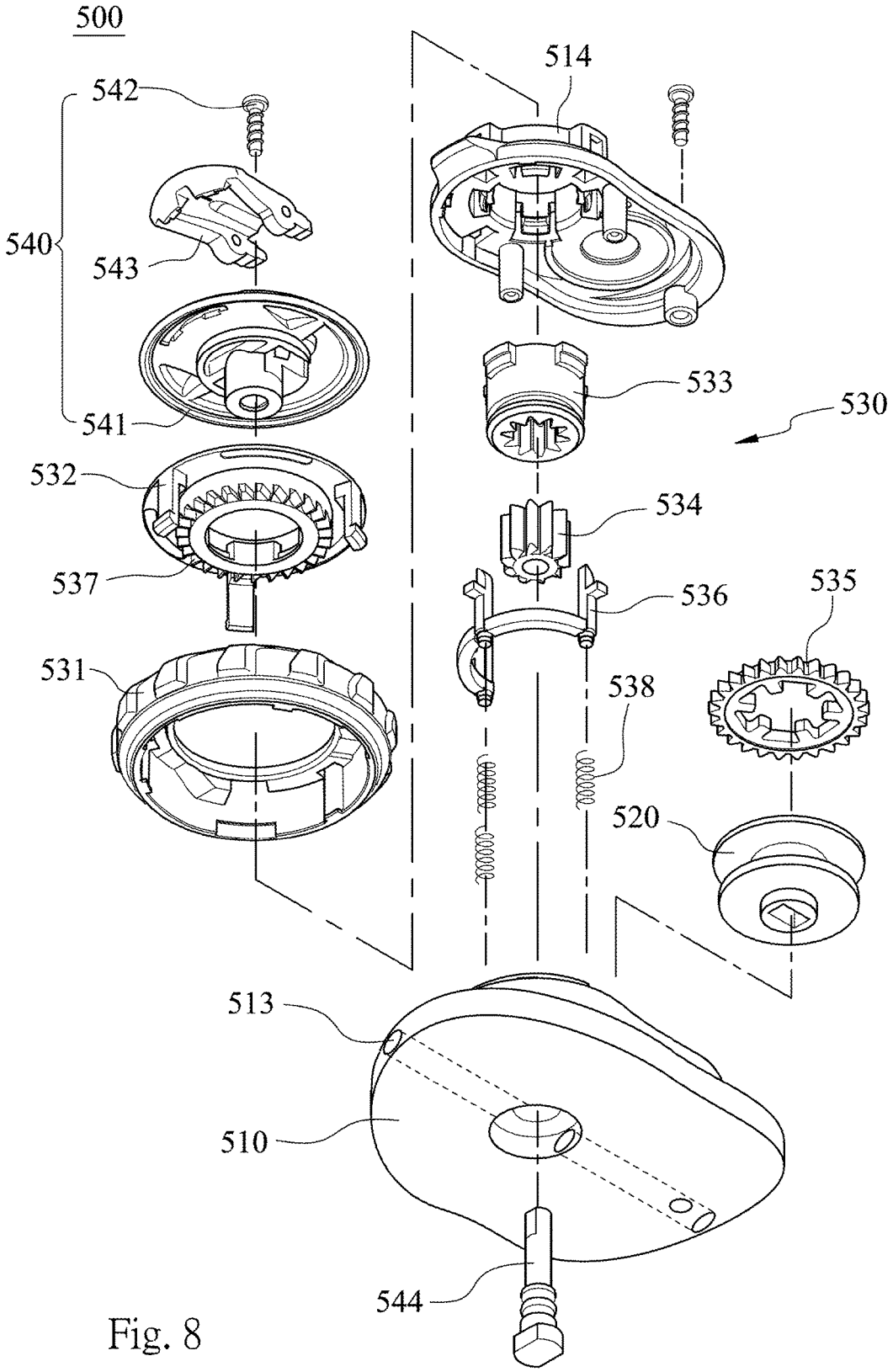
FIG. 8 shows another exploded view of the fastening mechanism of FIG. 5.

Please refer to FIGS. 5 to 8 for another embodiment of fastening mechanism 500. FIG. 5 shows a schematic view of a fastening mechanism 500 of a lacing system according to another embodiment of the present disclosure. FIG. 6A shows a cross-sectional view of the fastening mechanism 500 of FIG. 5 under an engaging state taken along Line 3-3. FIG. 6B shows a cross-sectional view of the fastening mechanism 500 of FIG. 5 under a disengaging state taken along Line 3-3. FIG. 7 shows an exploded view of the fastening mechanism 500 of FIG. 5. FIG. 8 shows another exploded view of the fastening mechanism 500 of FIG. 5.

The fastening mechanism 500 includes a housing 510, a reel member 520, a knob 530 and a releasing mechanism 540. The housing 510 includes a first connecting hole 511, a second connecting hole 512, a passage 513 and a housing cover 514. A first end of the lace 300 is guided by the first guide 201 and the second guide 202 to enter the housing 510 via the first connecting hole 511, and is securely connected to the house 510. A second end of the lace 300 is guided by the first guide 201 and the second guide 202 to enter the housing 510 via the second connecting hole 512. The second end of the lace 300 is detachably connected to the reel member 520 and can be wound by the reel member 520. The housing cover 514 is covered on the housing 510. Precisely, the reel member 520 includes a knotting hole 521, and the second end can be knotted after passing through the knotting hole 521 such that the second end is detachably connected to the reel member.

The reel member 520 is coupled to the housing 510 to loosen or fasten the lace 300, and the reel member 520 can be rotated along the first direction related to the housing 510. The reel member 520 can be received between the housing cover 514 and the housing 510.

The knob 530 is used for rotating the reel member 520. The knob 530 includes a handheld portion 531, a cover body 532, a rotating member 533, a linking gear 534, an engaging gear 535, a plurality of limited teeth 537 and three springs 538. The handheld portion 531 is assembled with the cover body 532. The cover body 532 is connected to the rotating member 533, and the rotating member 533 is connected to the linking gear 534. The linking gear 534 is engaged with the engaging gear 535, and the engaging gear 535 is coupled to the reel member 520. Hence, the cover body 532 can be rotated with the handheld portion 531 simultaneously, and the cover body 532 rotates the rotating member 533, the linking gear 534 and the engaging gear 535. The reel member 520 is linked by the engaging gear 535. The plurality of limited teeth 537 is disposed at the cover body 532 and is facing toward the handheld portion 531. The inclines of the limiting teeth 537 can be coordinated with three top inclines of the pawl 536. The knob 530 can only be rotated along the first direction owning to the cooperation of the limiting teeth 537, the pawl 536 and the spring 538; therefore, when the linking gear 534 is engaged with the engaging gear 535, the rotation direction of the reel member 520 is limited.

The releasing mechanism 540 is disposed at the fastening mechanism 500 for controlling the engagement and the disengagement between the linking gear 534 and the engaging gear 535. The releasing mechanism 540 includes a protecting cover 541, a screw 542, a releasing button 543 and a clasping member 544. The protecting cover 541 is disposed on the cover body 532. The releasing button 543 is pivotally disposed at the protecting cover 541, and the screw 542 connects the protecting cover 541 to the clasping member 544. The clasping member 544 movably disposed at the housing 510. The clasping member 544 is passed through the linking gear 534 to change the position of the linking gear 534, and whether the linking gear 534 is engaged with the engaging gear 535 is depended on the position of the linking gear 534.

Please refer to FIG. 6A and FIG. 6B, the engagement and the disengagement between the linking gear 534 and the engaging gear 535 is controlled by the releasing mechanism 540. When the releasing button 543 is fully abutted the protecting cover 541 (as shown in FIG. 6A), the linking gear 534 is engaged with the engaging gear 535. The reel member 520 which is connected to the engaging gear 535 is limited and can only be rotated along the fastening direction to fasten the second end of the lace 300, which is connected to the reel member 520. When the releasing button 543 is pushed upward (as shown in FIG. 6B), the protecting cover 541 and the linking gear 534 are upward simultaneously to release the linking gear 534 from the engaging gear 535. The reel member 520 is released from the linking gear 534 and can be rotated along the loosen direction owning to the tension of the lace 300; therefore, the second end of the lace 300, which is connected to the reel member 520, can be quickly loosened.

The lace 300 can pass the fastening mechanism 500 and can be wound inside the fastening mechanism 500 by the reel member 520; hence, the lace 300 will not be loosened due to the interference of the external environment. The reel member 520 can be rotated by the knob 530 to fasten the lace 300, and the lace 300 can be quickly released by the fastening mechanism 500 so as to release the shoe 100. Besides, the gear ratio between the linking gear 534 and the engaging gear 535 can be changed according to different demands so as to adjust the tension of lacing system.

Figure 9:
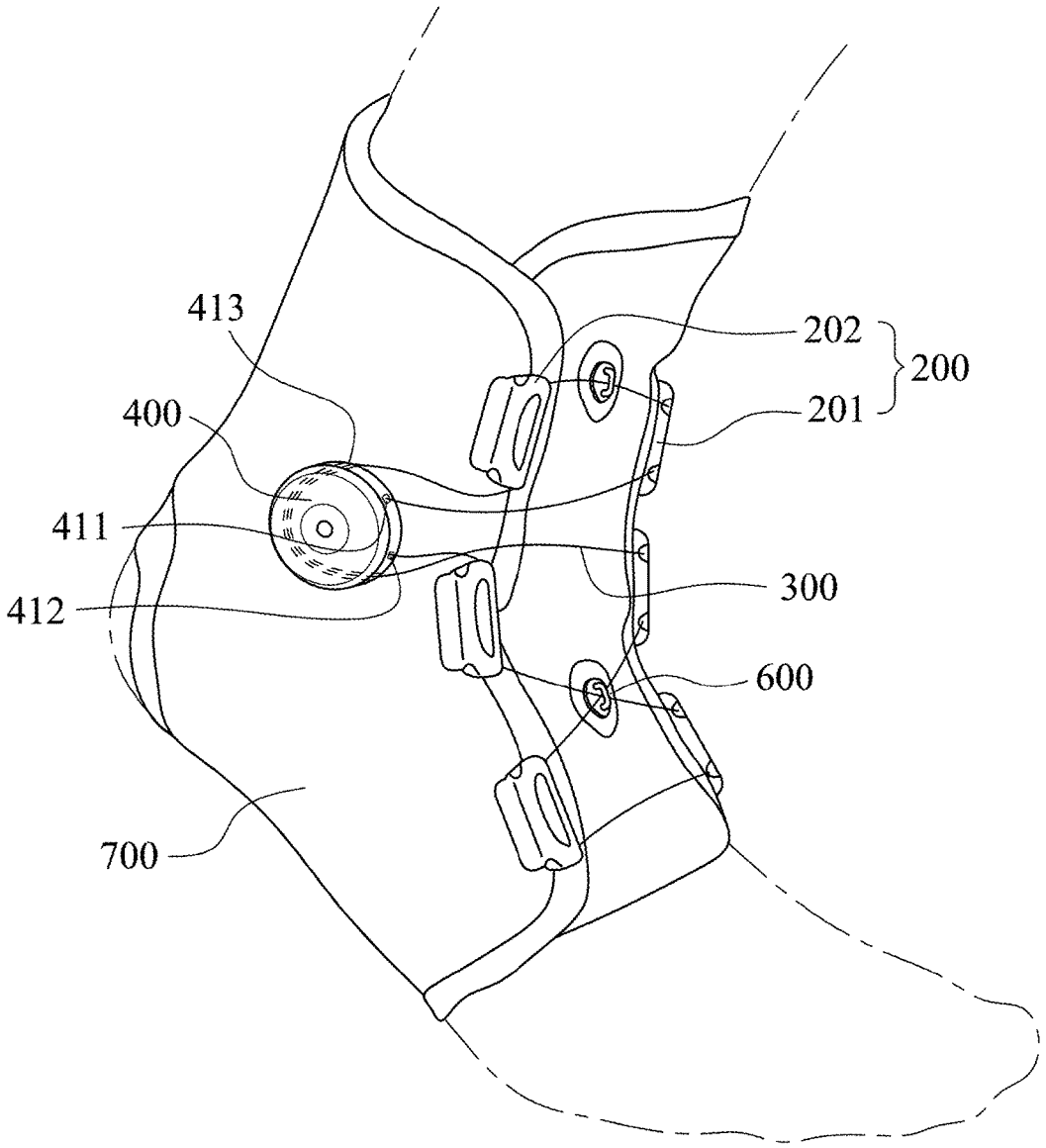
FIG. 9 shows a schematic view of a lacing system according to a further embodiment of the present disclosure.
Figure 10:
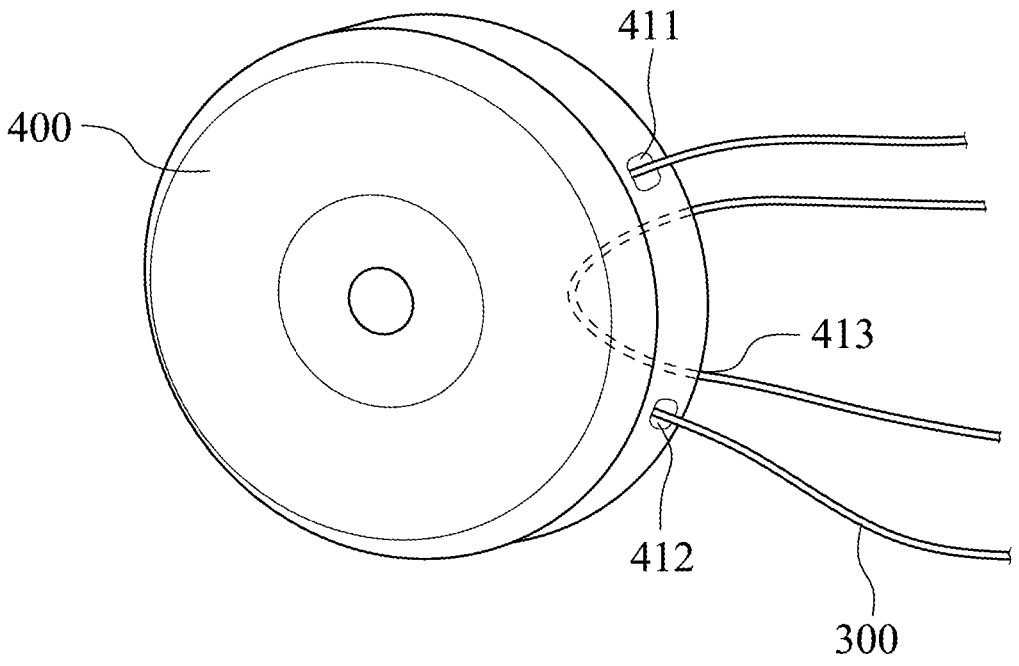
FIG. 10 shows a schematic view of a lacing system according to yet another embodiment of the present disclosure.

Please refer to FIG. 9 and FIG. 10. FIG. 9 shows a schematic view of a lacing system according to a further embodiment of the present disclosure. FIG. 10 shows a schematic view of a lacing system according to yet another embodiment of the present disclosure. The article of the lacing system can be a brace for protecting the lag in this embodiment. The lacing system includes a brace 700, a guiding portion 200, a lace 300, a fastening mechanism 400 and an anti-friction member 600. The relationship between the components is similar to the embodiment mentioned above, but the fastening mechanism 400 can be disposed at the two sides or other place of the brace 700 according to the demands for convenient operation.

The lace 300 is passed the passage 413 to pass through the fastening mechanism 400. A first end of the lace 300 can be guided by the first guide 201 and the second guide 202 to enter the fastening mechanism 400 via the first connecting hole 411, and the first end can be detachably connected to the reel member (not shown). A second end of the lace 300 can be guided by the first guide 201 and the second guide 202 to enter the fastening mechanism 400 via the second connecting hole 412, and the second end can be detachably connected to the reel member. The curved passage 413 is shown in FIG. 9, and a distance between the two openings of the passage 413 is larger than a distance between the first connecting hole 411 and the second connecting hole 412. Or the distance between the two openings of the passage 413 is smaller than the distance between the first connecting hole 411 and the second connecting hole 412, as shown in FIG. 10. Through the disposition, the lace 300 can pass the passage 413 smoothly in order to reduce the friction of the lace 300 and increase the life time of the lace 300. Besides, the user can fasten or loosen the brace 700 quickly.

As it can be known from the above embodiments, the lacing system includes the following advantages: 1. the lace can be received inside the fastening mechanism such that the lace will not be loosed owing to the interference of the external environment. 2. broken of the lace can be prevent due to the balanced load of the lace, and the article can be efficiently fastened or covered. 3. the article can be released quickly by the releasing mechanism. 4. the structure is simplified, and a disablement of the lacing system can be avoid.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A lacing system, comprising:

an article, comprising:

a first side;

a second side corresponding to the first side; and a lacing zone located between the first side and the second side;

a guiding portion positioned at the article, comprising:

a first guide positioned on the first side and being located in the lacing zone, the first guide facing toward the second side; and a second guide positioned on the second side and being located in the lacing zone, the second guide facing toward the first side;

a lace guided by the guiding portion and being extended in a zig-zag pattern throughout the lacing zone; and a fastening mechanism positioned at the article to loosen or fasten the lace, comprising:

a housing, comprising:

a connecting hole provided for the lace to enter the fastening mechanism; and a passage positioned at the housing to allow the lace to pass through the fastening mechanism; and a reel member coupled to the housing to loosen or fasten the lace, the reel member rotated along a first direction relating to the housing;

wherein a first end of the lace is passed through the passage, the guiding portion and the connecting hole to detachably connect to the reel member, a second end of the lace is passed through the connecting hole to detachably connect to the reel member, and the first and second ends of the lace are fastened simultaneously by rotating the reel member along the first direction.

2. The lacing system of claim 1, wherein the fastening mechanism further comprises:

a pawl coupled to the reel member to inhibit the reel member from rotating.

3. The lacing system of claim 2, wherein the reel member further comprises:

a plurality of engaging teeth integrally connected to the reel member, the engaging teeth coordinated with the pawl to restrict a rotating direction of the reel member.

4. The lacing system of claim 3, further comprising:

a releasing mechanism positioned at the fastening mechanism;

wherein a disengagement and an engagement between the pawl and the engaging teeth are controlled by the releasing mechanism.

5. The lacing system of claim 3, wherein when the pawl is engaged with the engaging teeth, the reel member is only allowed to rotate along the first direction.

6. The lacing system of claim 3, wherein when the pawl is disengaged with the engaging teeth, the reel member is allowed to rotate along the first direction.

7. The lacing system of claim 3, wherein the reel member further comprises:

a handheld portion integrally connected to the reel member, the handheld portion being used for manually controlling a rotation of the reel member.

8. A lacing system, comprising:

an article, comprising:

a first side;

a second side corresponding to the first side; and a lacing zone located between the first side and the second side;

a guiding portion positioned at the article, comprising:

a first guide positioned on the first side and being located in the lacing zone, the first guide facing toward the second side; and a second guide positioned on the second side and being located in the lacing zone, the second guide facing toward the first side;

a lace guided by the guiding portion and being extended in a zig-zag pattern throughout the lacing zone; and a fastening mechanism positioned at the article to loosen or fasten the lace, comprising:

a housing, comprising:

a connecting hole providing for the lace to enter the fastening mechanism; and a passage positioned at the housing to allow the lace to pass through the fastening mechanism; and a reel member coupled with the housing to loosen or fasten the lace, the reel member being rotated along a first direction relating to the housing;

wherein a first end of the lace is passed through the passage, the guiding portion and the connecting hole to securely connect inside the housing, a second end of the lace is passed through the connecting hole to detachably connect to the reel member and is rotated by the reel member, and the second end of the lace is fastened by rotating the reel member along the first direction.

9. The lacing system of claim 8, wherein the fastening mechanism further comprises:

a pawl coupled to the reel member to restrict the reel from rotating.

10. The lacing system of claim 9, wherein the fastening mechanism further comprises:

a plurality of limiting teeth coordinated with the pawl to restrict a rotating direction of the reel member.

* * * * *